US005301955A

United States Patent [19]

Fedullo

[11] Patent Number: 5,301,955

[45] Date of Patent: Apr. 12, 1994

[54] STREET PADDLE SOCCER GAME

[76] Inventor: Jose Fedullo, 4571-A Sheila St., Commerce, Calif. 90040

[21] Appl. No.: 993,640

[22] Filed: Dec. 21, 1992

[51] Int. Cl.[5] ..... A63B 43/06; A63B 59/00; A63B 63/00

[52] U.S. Cl. ..... 273/411; 273/58 G; 273/67 R; 273/400; 273/DIG. 24

[58] Field of Search ..... 273/411, 67, 58 G, 30, 273/400, 401, 396, 398, DIG. 24

[56] References Cited

U.S. PATENT DOCUMENTS 3,804,411 4/1974 Hendry ..... 273/58 G
3,923,304 12/1975 Warren ..... 273/398
5,080,375 1/1992 Moosavi ..... 273/400

FOREIGN PATENT DOCUMENTS 2137515 2/1973 Fed. Rep. of Germany ... 273/DIG. 24
2448366 4/1976 Fed. Rep. of Germany ..... 273/411

*Primary Examiner*—William H. Grieb
*Attorney, Agent, or Firm*—Erik M. Arnaem

[57] ABSTRACT

A street paddle soccer game apparatus includes a miniature soccer goal, a resilient game ball, and a plurality of ball-striker paddles (one for each player). The miniature goal includes a four-sided framework having a net draped around its top, rear and side surfaces; the framework has two side frame assemblies and two detachable crosspieces extending therebetween so that the framework can be broken down into smaller flat sections for compact storage. The resilient game ball and the ball-striker paddles can be self-illuminated for the purpose of playing the game under nighttime conditions.

5 Claims, 2 Drawing Sheets

STREET PADDLE SOCCER GAME

BACKGROUND OF THE INVENTION

1. Field of the Invention

This invention relates to a miniature soccer game, wherein a relatively small diameter ball is moved over a playing surface by means of hand-held paddles. The players use the paddles to bat the ball back and forth until the ball enters a miniature soccer goal located at one end of the playing surface.

2. Prior Art Developments

The game of soccer involves kicking or bumping a hollow soft-surfaced ball over a playing field extending between two goals located at opposite ends of the playing surface. Each goal is an upright cage having a width of twenty four feet and a height of eight feet. The length of the playing surface can vary from about three hundred feet to about three hundred sixty feet.

A considerable field area is required in order to play the game of soccer. The present invention contemplates a miniature version of soccer, which requires a considerably smaller land area (or playing surface). The aim is to provide a game that can be played somewhat like soccer, but in restricted spaces, e.g. on small playgrounds, or on dead-end streets (devoid of automobiles). or on driveways, or in basements.

SUMMARY OF THE INVENTION

The invention relates to a game apparatus that includes at least one miniature soccer goal, a paddle for each game player, and a resilient ball adapted to be struck by a paddle controlled by any one of the players; the object of the game is for the players to use the paddles to bat or otherwise propel the game ball into either goal; the players are arranged in two opposing teams. Each team can be comprised of one or more players; preferably no more than five players make up each team. The playing surface can be relatively small (relative to the playing surface used in conventional soccer); typically the playing surface can be about twenty feet wide and fifty feet long, although the exact playing field dimensions are not critical. Preferably the playing surface is flat, hard and relatively smooth.

The game ball will be considerably smaller than a conventional soccer ball, preferably somewhat smaller than a conventional tennis ball; a ball diameter of about one and one half or two inches is practical. The ball will be resilient so that it can be bounced on the playing surface.

Each minature goal comprises an upright open-mouthed cage structure having a height of about fourteen inches and a transverse width (in the plane of the open mouth) of about thirty five inches. If there are two or more players on each team, one player will ordinarily be stationed in front of each miniature goal to act as the goalie.

Each ball-striking paddle will include a handle portion and a flat ball-striking portion. The flat ball-striking portion will have a surface area somewhat larger than that of a conventional table tennis paddle and somewhat smaller than that of a conventional tennis racquet. The size of the paddle is somewhat related to the size of the ball being used. A large size ball will ordinarily require a larger size paddle.

An aim of the invention is to provide a miniature version of a conventional soccer game, wherein the game apparatus can be packaged in a relatively small size carton for shipment, storage and display. To this end, each miniature soccer goal is comprised of a framework that can be knocked down into a relatively small sized shipping package; the framework preferably comprises two trapezoidal side frame assemblies and two tubular cross pieces, said cross pieces having detachable connections with the side frame assemblies whereby the framework can be separated into separate components arrangeable in a relatively flat compact shipping configuration. Each miniature goal further comprises a flexibile net that can be draped over the framework when the framework is in its erect operating condition.

By way of adding interest to the game, the game ball and paddles are self-illuminated, whereby the game can be played in darkness or in semi-darkness. The self-illuminated ball can be observed as a multiple number of tiny light rays generated from within the ball interior space; players see the multiple light rays even though the ball is otherwise not visible in the darkened atmosphere. Each paddle will have an interior battery-operated light arranged to illuminate the flat ball-striking surfaces of the paddle. Opposing players can observe the paddle even though the game is being played in darkness or in a near-darkness condition.

THE DRAWINGS

DESCRIPTION OF A PREFERRED EMBODIMENT OF THE INVENTION

Figure 3:
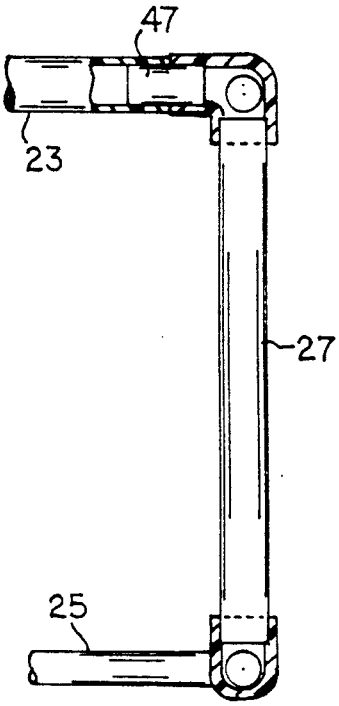
FIG. 3 is a sectional view taken on line 3—3 in FIG. 3.

The apparatus depicted in FIGS. 1 through 8 can be used in playing a game that can be conveniently described as Street Paddle Soccer. The game will ordinarily be played with two teams, made up of from one to five players per team. Each player on each team has one paddle; there is one game ball that is to be struck by the paddles held by the players, or alternately by the chest areas or head areas of the player's body (similar to procedures used in the conventional game of soccer).

The game will be played within a defined area, hereinafter referred to as the playing surface. Should the ball be hit out of bounds (i.e. out of the playing surface) the team not responsible for the out-of-bounds ball travel is given possession of the ball when play resumes. Should the ball travel beyond an end line of the playing surface (where each goal is located) the ball can be put in play from the nearest corner, similar to the rules that prevail in real life soccer.

The game will preferably be played for a certain length of time, e.g. one hour, or until one team scores a predetermined number of goals. A goal is scored when one team drives the game ball into the other team's goal.

The ball can be advanced by various means and techniques, e.g. batting the ball forward with a paddle, carrying the ball on the paddle surface while running along the playing surface, hitting the ball with one's head or chest, or passing the ball to a teammate (with a paddle or one's body).

The players are not allowed to move the ball with their hands, feet or arms. In event of such a rule violation the other team is given the ball. Also, the rules prohibit aggressive behavior not directed to ball movement, e.g. hitting or grabbing the opposing player, scratching or tripping. Should a foul occur while a player is attempting a shot on the opposing team's goal then the player is given a free shot at some designated distance from the goal, e.g. ten feet; during the free shot the goal can be defended by one (only one) of the defending team's players.

Many of the rules used in real life soccer can be used in the miniaturized version herein described. For example, the rules can provide for loss of the ball when the offensive team has one or more of its players offside, i.e., located downfield beyond the last player on the defending team (other than the goalie).

The game will ordinarily be played with two miniature goals located at opposite ends of the playing surface. FIGS. 1 through 5 illustrate features of a goal that can be used. The illustrated goal comprises a four-sided framework 10 and a netting 12 drapped over the framework to form a cage structure 14 having an open mouth 16 for passage of a ball into the space circumscribed by netting 12. The goal can have various dimensions. However, in a preferred construction the goal has a height dimension 17 of about fifteen inches, and a transverse width dimension 19 of about thirty six inches.

Figure 2:
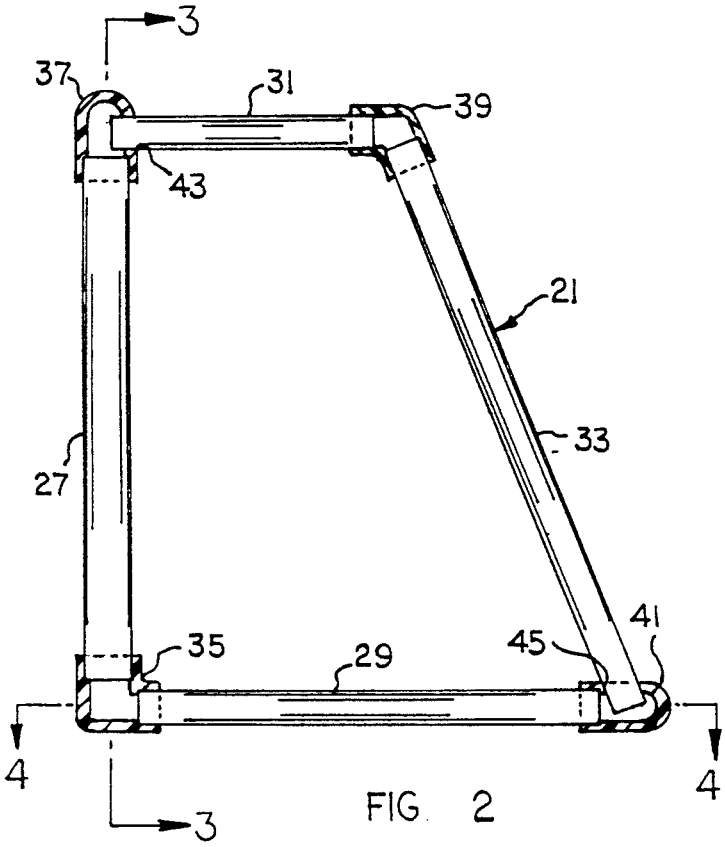
FIG. 2 is an enlarged sectional view taken on line 2—2 in FIG. 1.
Figure 4:
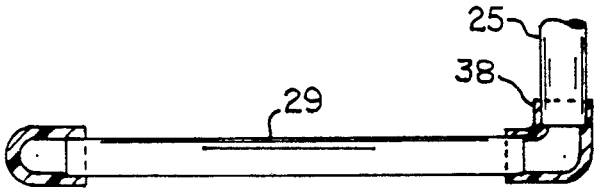
FIG. 4 is a sectional view taken on line 4—4 in FIG. 2.

Framework 10 comprises two generally similar upstanding parallel side frame assemblies 21, and two tubular crosspieces 23 and 25 extending transversely between the frame assemblies. Each side frame assembly preferably comprises a series of permanently-connected tubes arranged in a trapezoidal configuration, as viewed in side elevation (FIG. 2). The two crosspieces 23 and 25 have their ends detachably connected to the trapezoidal side frame assemblies, such that the crosspieces can be disconnected for the purpose of knocking the framework down into a relatively flat compact bundle, especially suited to low volume storage, shipment or display.

Each side frame assembly 21 comprises a front vertical tube 27 formed out of plastic, a lower horizontal tube 29 extending rearwardly from tube 27, an upper horizontal tube 31 extending rearwardly from tube 27 directly above the lower tube 27, and a rear tube 33 joining the rear ends of the upper and lower tubes. Tubes 29, 31 and 33 are preferably formed of plastic. Tube 31 is appreciably shorter than tube 29, such that the rear tube 33 is inclined in the forward (rear-to-front) direction.

The various tubes 27, 29, 31 and 33 may be connected together, using essentially conventional socket-type connectors 35, 37, 39 and 41. However, connectors 37 and 41 are modified to the extent that holes 43 and 45 are formed therein to accommodate the ends of tubes 31 and 33, respectively. The various tubes may be connected to the associated connectors by conventional adhesives. As previously noted, the connected tubes collectively form a side frame assembly having a trapezoidal configuration.

Tubular cross piece 23 has open ends thereof adapted to telescopically fit over pins 47 that extend laterally from the connectors 37 at the upper ends of vertical tubes 27; each pin 47 is preferably joined to the associated connector 37 by an adhesive connection. Each pin 37 is detachably connected to cross piece 23.

Tubular crosspiece 25 has open ends adapted to be telescopically received in sockets 38 incoorporated into the connectors 41. The connection between crosspiece 25 and the sockets 38 is a detachable connection, such that cross piece 25 (and cross piece 23) can be disconnected from side frame assemblies 21.

Netting 12 is shaped to the outside dimensions of framework 10, such that edge areas of the netting are attached to the various tubes 27, 29 and 33 in each side frame assembly 21. These edge connections can be permanent (adhesive) connections, if so desired. Thus the netting can be permanently attached to both side frame assemblies 21, while still permitting connection (or disconnection) of tubular crosspieces 23 and 25 relative to the side frame assemblies. The netting is sufficiently stretchable that it can accommodate insertional motions of tubular pieces 23 and 25 onto the pins 47 and sockets 38.

The netting can be detachably connected to corsspieces 23 and 25 by using strips of adhesive material, sometimes referred to as hook and loop material; such material is commercially available under the tradename VELCRO. FIG. 23 shows a strip 50 of hook and loop material adhesively carried on the surface of crosspiece 23; a mating strip 52 is adhesively or otherwise attached to the edge of netting 12. When the mating strips 50 and 52 are pressed together the fibrouse hook and loop materials interlock to form a detachable adhesive connection between the netting and crosspiece 23. The strips 50 and 52 can extend along the entire transverse dimension of the netting and crosspiece; alternately the strips can be discontinuous patches located at spaced points along the netting and crosspiece.

Figure 5:
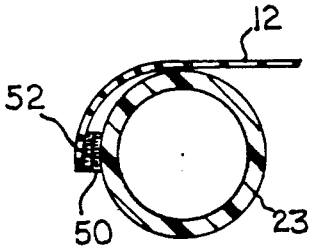
FIG. 5 is an enlarged sectional view taken through a frame element used in the FIG. 1 soccer goal, and illustrating an adhesive connecting means for attaching the soccer netting to the frame element.

The connecting mechanism depicted in FIG. 5 can also be used for connecting the netting to crosspiece 25.

Figure 1:
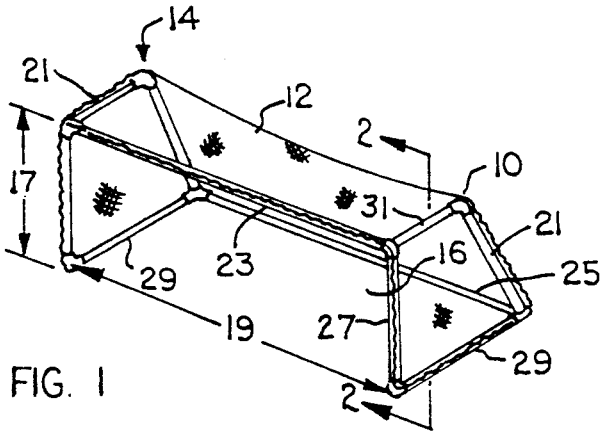
FIG. 1 is a perspective view of a miniature soccer goal constructed according to the invention.
Figure 6:
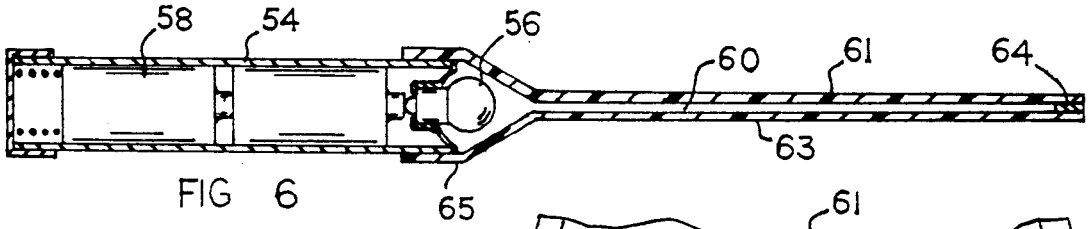
FIG. 6 is a sectional view taken through a ball-striking paddle that can be used in playing a miniature soccer game according to the invention.
Figure 7:
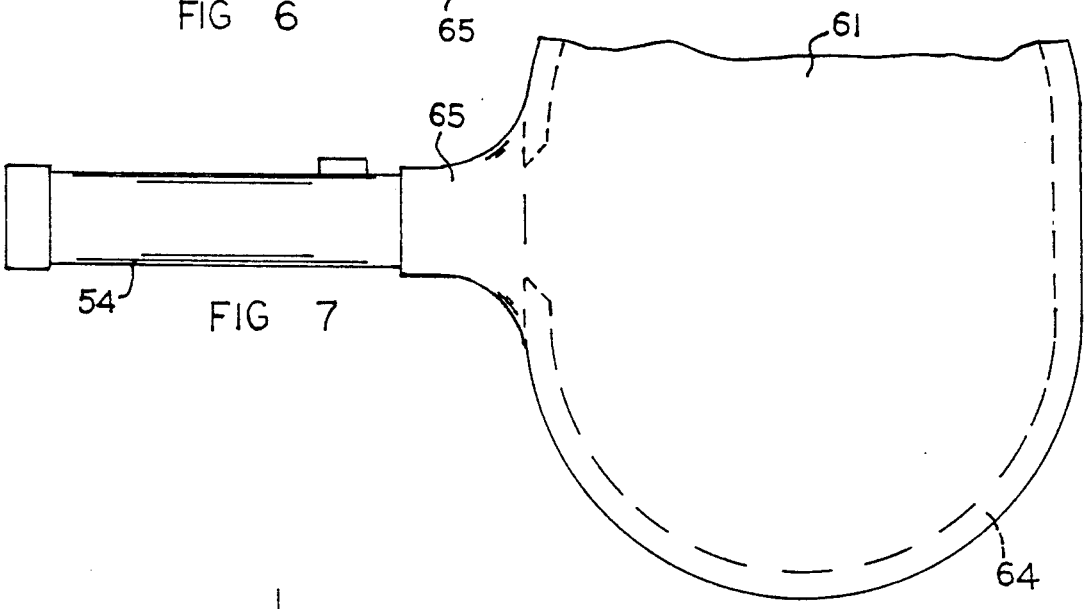
FIG. 7 is a fragmentary top plan view of the paddle shown in FIG. 6.

FIGS. 6 and 7 show features of a paddle 53 that can be used in conjunction with the goal structure of FIG. 1. The overall size of the paddle can be slightly greater than that of a conventional table tennis paddle. A handle portion 54 of the paddle is constructed as an essentially conventional battery-containment flashlight housing; a small light bulb 56 is energized by two dry cell batteries 58, whereby the light bulb is enabled to direct light rays into a narrow flat space 60 formed between two flat parallel sheets 61 and 63 formed of transparent plastic material; a spacer strip 64 extends between the sheets around the sheet edges to form flat space 60. Sheets 61 and 63 have arcuate molded portions thereof joined together to form a tubular socket, designated generally by numeral 65; the socket fits over the end of handle (housing) 54; whereby the paddle can be held in a person's hand for ball-striking purposes.

The illustrated paddle can be effectively used in the darkness, since bulb 56 will illuminate the flat ball-striking surfaces of transparent sheets 61 and 63; the illuminated sheet surfaces are thus visible in spite of the darkness condition.

Figure 8:
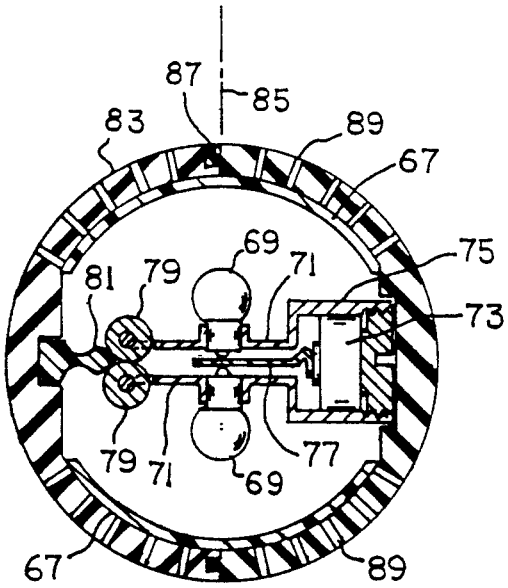
FIG. 8 is a sectional view taken through a self-illuminated ball that can be used with the apparatus depicted in FIGS. 1 through 7.

FIG. 8 illustrates a self-illuminated ball that can be used with the illuminated paddle of FIGS. 6 and 7. The ball comprises a hollow spherical rigid core 67 formed of a transparent plastic material; holes are formed in opposite ends of the core for access to a battery operated light system located within the hollow spherical core. The battery-operated light system comprises two light bulbs 69 carried on resilient strips 71, and a small flat dry cell battery 73 located within a cup-shaped battery housing 75. A conductive strip 77 has one end thereof cemented or otherwise attached to a battery terminal. The other battery terminal is attached to resilient strips 71 (via housing 75), such that when strips 71 are in the FIG. 8 positions the lights 69 are illuminated.

Each resilient strip 71 carries a roller 79, with the rollers being urged together by the biasing action of the two resilient strips. The rollers can be separated from each other by rightward movement of a plastic cam member 81 that is positioned between the two rollers and an elastomeric resilient spherical shell 83. When the rollers separate, the strips 71 move apart to disconnect the electrical connections between bulbs 69 and the conductive strip 77.

Elastomeric shell 83 comprises two hemi-spherical shell elements joined together on a diammetrical plane 85; an interlocking an annular groove-rib connection 87 can be used to detachably connect the shells together for enabling access to the light-battery system while still achieving a resilient ball configuration. Elastomeric shell 83 preferably has a wall thickness somewhat greater than that of rigid cord 67 in order to achieve a desired degree of resilience.

Shell 83 has a large number of relatively small openings 89 extending therealong, whereby light rays generated by bulbs 69 are enabled to radiate through the wall of transparent core 67 and the various openings 89. When the game is played under darkness, or near darkness, the ball is effectively made visible by the light rays passing outwardly through openings 89.

Light bulbs 69 can be extinguished by manually pressing on the surface of shall 83 so as to move cam element 81 rightward to a position for spreading rollers 79 apart. If shell 83 is depressed slowly cam element 81 can maintain a position for spreading the rollers apart; the cam element can be returned to its FIG. 8 position by exerting a rapid short term pressure on the shell surface. Cam 81 is preferably not attached to shell 83; therefore the cam is enabled to hold rollers 79 apart while the shell returns to its FIG. 8 condition. The illustrated cam mechanism represents one of several ways for tuning light bulbs 69 on or off.

The drawings illustrate an apparatus comprised of a miniature goal, paddle construction, and ball construction that can be used in combination when playing a street soccer paddle game according to the theory of the invention. Some variations in construction of the game apparatus can be employed while still practicing the invention.

What is claimed is:

1. Game apparatus comprising at least one miniature soccer goal, a paddle for each game player, and a resilient ball adapted to be struck by any one of the paddles for travel into the soccer goal; each soccer goal comprising an upstanding four-sided framework, and a netting draped over the framework to form a cage structure having an open mouth for passage of the ball into the space circumscribed by the netting; said framework comprising two upstanding parallel side frame assemblies and two tubular crosspieces extending transversely between said frame assemblies; each side frame assembly comprising a front vertical tube, a lower horizontal tube extending rearwardly from said front tube, an upper horizontal tube extending rearwardly from said front tube directly above said lower tube, and a rear tube joining the upper and lower tubes in the space behind the front tube; said upper tube being appreciably shorter than the lower tube, whereby said rear tube is inclined in the forward direction; each side frame assembly having a trapezoidal configuration; one of said tubular cross-pieces extending between the side frame assemblies so that each end of said one tubular crosspiece connects with the joint formed between a front tube and an upper horizontal tube of the respective side frame assembly; the other tubular crosspiece extending between the side frame assemblies so that each end of said other tubular crosspiece connects with the joint formed between the lower tube and the rear tube of the respective side frame assembly; each paddle comprising a handle portion and a flat ball-striking portion; each handle portion comprising a battery-containment flashlight having a light bulb in one end thereof; each ball-striking portion comprising two flat parallel sheets of transparent plastic material having edge areas thereof joined together so that the facing surfaces thereof are spaced a slight distance apart; each ball-striking portion being joined to the associated handle portion so that the light bulb shines into the space formed between the transparent plastic sheets.

2. Game apparatus comprising at least one miniature soccer goal, a paddle for each game player, and a resilient ball adapted to be struck by any one of the paddles for travel into the soccer goal; each soccer goal comprising an upstanding four-sided framework, and a netting draped over the framework to form a cage structure having an open mouth for passage of the ball into the space circumscribed by the netting; said framework comprising two upstanding parallel side frame assemblies and two tubular crosspieces extending transversely between said frame assemblies; each side frame assembly comprising a front vertical tube, a lower horizontal tube extending rearwardly from said front tube, an upper horizontal tube extending rearwardly from said front tube directly above said lower tube, and a rear tube joining the upper and lower tubes in the space behind the front tube; said upper tube being appreciably shorter than the lower tube, whereby said rear tube is inclined in the forward direction; each side frame assembly having a trapezoidal configuration; one of said tubular crosspieces extending between the side frame assemblies so that each end of said one tubular crosspiece connects with the joint fromed between a front tube and an upper horizontal tube of the respective side frame assembly; the other tubular crosspiece extending between the side frame assemblies so that each end of said other tubular crosspiece connects with the joint formed between the lower tube and the rear tube of the respective side frame assembly; said resilient ball comprising a hollow-rigid transparent core, a battery and light bulb located within said transparent core for illuminating the core surface, and a multi-piece spherical shell surrounding said core; said spherical shell being formed of a resilient elastomeric material; said shell having a multiple number of a relatively small openings extending therealong, whereby light rays are enabled to radiate from the illuminated core through said openings.

3. The game apparatus of claim 2, wherein the wall thickness of the spherical shell is greater than the wall thickness of the hollow rigid core.

4. Game apparatus comprising at least one miniature soccer goal, a paddle for each game player, and a resilient ball adapted to be struck by any one of the paddles for travel into the soccer goal; each soccer goal comprising an upstanding four-sided framework, and a netting draped over the framework to form a cage structure having an open mouth for passage of the ball into the space circumscribed by the netting; said framework comprising two upstanding parallel side frame assemblies and two one piece tubular crosspieces extending transversely between said frame assemblies; each side frame assembly comprising a front vertical tube, a lower horizontal tube extending rearwardly from said front tube, an upper horizontal tube extending rearwardly from said front tube directly above said lower tube, and a rear tube joining the upper and lower tubes in the space behind the front tube; said upper tube being appreciably shorter than the lower tube, whereby said rear tube is inclined in the forward direction; each side frame assembly having a trapezoidal configuration; one of said tubular crosspieces extending between the side frame assemblies so that each end of said one tubular crosspiece connects with the joint formed between a front tube and an upper horizontal tube of the respective side frame assembly; the other tubular crosspiece extending between the side frame assemblies so that each end of said other tubular crosspiece connects with the joint formed between the lower tube and the rear tube of the respective side assembly; the tubes in each side frame assembly being permanently joined together; each tubular crosspiece having a detachable telescopic onnection with each side frame assembly; said netting having edge areas thereof permanently attached to the front tube, lower tube and rear tube of each side frame assembly; said netting having edge areas thereof detachably connected to said crosspieces.

5. The game apparatus of claim 4, and further comprising a strip of hook and loop adhesive material extending along each tubular crosspiece; said netting having mating strips of hook and loop adhesive material carried on its edges for detachable adhesive connection to the adhesive strips on the respective crosspieces.

* * * * *